US006173647B1

(12) United States Patent
Kakuta et al.

(10) Patent No.: US 6,173,647 B1
(45) **Date of Patent: *Jan. 16, 2001**

(54) SOLID-INK PRINTING ORIGINAL PLATE AND A PROCESS FOR PRODUCING THE SAME

(75) Inventors: Atsushi Kakuta; Masatoshi Sakata; Yutaka Shoji; Shigenori Suematsu, all of Ibaraki (JP)

(73) Assignee: Hitachi Koki Co., Ltd., Tokyo (JP)

( * ) Notice: Under 35 U.S.C. 154(b), the term of this patent shall be extended for 0 days.

This patent is subject to a terminal disclaimer.

(21) Appl. No.: 09/192,261

(22) Filed: Nov. 16, 1998

(30) Foreign Application Priority Data

Nov. 14, 1997 (JP) ..... 9-313123

(51) Int. Cl.[7] ..... B41C 1/10
(52) U.S. Cl. ..... 101/466; 347/88; 347/105
(58) Field of Search ..... 101/463.1, 465–467, 101/457, 462; 347/88, 99, 103, 105, 106, 107

(56) References Cited

U.S. PATENT DOCUMENTS 4,833,486 * 5/1989 Zerillo ..... 101/463.1
4,951,067 * 8/1990 Spehrley, Jr. ..... 347/88
5,182,572 * 1/1993 Merritt et al. ..... 347/88
5,312,654 * 5/1994 Arimatsu et al. ..... 427/511
5,354,368 * 10/1994 Larson, Jr. ..... 347/99
5,413,843 * 5/1995 Mann et al. ..... 347/105
5,614,933 * 3/1997 Hindman et al. ..... 347/88

* cited by examiner

*Primary Examiner*—Stephen R. Funk
(74) *Attorney, Agent, or Firm*—Sughrue, Mion, Zinn, Macpeak & Seas, PLLC

(57) ABSTRACT

A solid-ink printing original plate which comprises a substrate and an image comprising an ink dot formed on the substrate, and which is prepared by a process comprising the steps of: melting a solid ink that is a solid at a room temperature; and jetting the melt of the solid ink onto a substrate to form an ink dot, wherein the ink dots that have solidified on the substrate have an ink dot height of at least 5 $\mu$m, and a ratio (aspect ratio) of the ink dot height to the minor axis size of the ink dot of from 0.05 to 0.5. Also disclosed is a process for producing the solid-ink printing original plate.

16 Claims, No Drawings

SOLID-INK PRINTING ORIGINAL PLATE AND A PROCESS FOR PRODUCING THE SAME

FIELD OF THE INVENTION

This invention relates to a solid-ink printing original plate and a process for producing the same.

BACKGROUND OF THE INVENTION

Photomechanical methods have been widely used in producing printing original plates. These systems comprise: mask assembling and other steps (collectively referred to as "plate assembly") that are carried out from a camera-ready art drawing or a negative film of a photographed picture; preparing a prepress plate; and preparing proofs and a printing original plate (press plate) on the basis of the prepress plate, to thereby carry out printing. In recent years, on the other hand, a DTP (desk top publishing) process is occasionally practiced, in which all steps up to the preparation of a prepress plate are digitized. In the above-described DTP process, a prepress plate is prepared by an electronic output (such as exposure with a laser) from a computer having the necessary information such as text and graphic elements stored in a memory, and subsequent steps are done as in the photomechanical method to make proofs and a press plate, to thereby carry out printing. The DTP process has the advantage of eliminating the need for preparing a camera-ready copy for each proofing step and thereby simplifying the overall process. A more simplified approach called CTP (computer-to-plate) has been developed and it is characterized by carrying out all steps up to the production of a press plate by the digital imaging technology. With this method, not only proofing but also various image processing steps can be accomplished efficiently. In its most desirable situation, press plate making can be done directly without any special chemical and physical treatments.

Most of the substrates conventionally used to make press plates have layers of various kinds of light-sensitive materials provided on the surface thereof. They include silver halide salt based light-sensitive materials (silver salt photographic plates), diazo-based light-sensitive materials (presensitized or PS plates) and photoconductive materials (electrophotographic plates), and require various kinds of chemical and physical post-exposure treatments for effecting development and fixing. Press plates can also be made without any post-exposure treatments and a known method that meets this need is characterized by the provision of a silicone rubber based surface layer and the removal of a protective layer after exposure to enable waterless plate making. Both methods are commercialized extensively but suffer from the problem of process complexity; hence, a more efficient method has been desired. For details of these aspects, see, for example, "Insatsu Kogaku Binran (Handbook of Printing Technology)", edited by the Printing Society of Japan, published by Gijutsudo, 1987.

Two approaches, the electrophotographic transfer process (xerography) and the liquid ink-jet process, have recently been developed to produce direct press plates. In the former method, the toner image formed on a photoreceptor drum is transferred onto a substrate, thereby making a press plate in a convenient and high-speed way. However, because of the limitations in the construction of xerographic equipment, large plates (e.g., larger than A2 size) which are important in practical applications are difficult to make. In addition, the electrophotographic transfer process has a theoretical disadvantage in that fine toner particles will scatter in small quantities during the development and transfer steps to foul the background area, and this provides stops for ink deposition, often causing a problem in the actual printing operation.

On the other hand, the liquid ink-jet process is capable of producing large plates directly. However, if the solvent is water-based, the resin component generally remains highly hydrophilic even after deposition on the substrate, and this often causes a problem in the receptivity of an ink during printing. To deal with this problem, and also for preventing the spread of printing ink dots, the substrate for press plate making must be subjected to a special pretreatment. These problems are less noticeable if inks based on organic solvents are used. However, liquid ink-jet marking has the following theoretical difficulties: the need for a drying step; limitations in resin choice and deposited amount; and the short press life of the final plate. Many patent applications have been filed in the art of applications of the liquid ink-jet process to the production of prepress or press plates. Examples thereof include: JP-A-51-84303 (The term "JP-A" used herein means an "unexamined published Japanese patent application), JP-A-54-94901, JP-A-56-62157, JP-A-56-113456, JP-A-60-245587, JP-A-62-25081, JP-A-62-62157, JP-A-63-102936, JP-A-63-109052, JP-A-4-69244, JP-A-4-69245, JP-A-4-282249, JP-A-4-317065, JP-A-5-204138, JP-A-5-269958, JP-A-8-324145 and JP-B-58-8991 (The term "JP-B" used herein means an "examined Japanese patent publication").

To solve the problems in the conventional techniques, JP-B-64-27953 proposes a method and an apparatus for performing ink-jet recording using the solid ink, in which an image former which is prepared from natural waxes and the like and which are solid at ordinary temperatures (solid ink) is liquefied with heat, jetted against a substrate to be deposited on its surface and solidified, to thereby make a press plate. Since the ink is solvent-free, many of the solvent-related problems involved in liquid ink-jet processes are eliminated. In addition, natural waxes and the like are generally hydrophobic, so satisfactory ink receptivity is assured in the printing operation. In spite of these great benefits, the description in the publication is general and is not specific enough to allow for commercial production of the desired long-lived and reliable press plate unless more comprehensive experiments and modification efforts are made in many aspects including abrasion resistance, ink affinity, ease of printing and printing quality.

Ink dots made of a solid ink generally assume the shape of a hemispherical lens of a certain thickness when they are deposited on the substrate. This is advantageous for peeling a sheet of printing paper from the press plate having the printing ink deposited thereon. However, on the other hand, the deposited ink dots gradually wear and deform from the surface and the resulting change in diameter has been a major factor in shortening the press life. In addition, the above-described JP-A-64-27953 and other publications make no adequate discussion of the physical properties of the ink material and the affinity for ink and the performance on the press plate have often turned out to be extremely poor.

SUMMARY OF THE INVENTION

The present invention has been accomplished under these circumstances.

Accordingly, an object of the present invention is to provide a solid-ink printing original plate that is sufficiently improved in abrasion resistance, ink affinity, ease of printing and the performance during printing to be useful in practical applications.

Another object of the present invention is to provide a process for producing the solid-ink printing original plate.

Other objects and effects of the present invention will become apparent from the following description.

The above described objects of the present invention have been achieved by providing the following solid-ink printing original plates and processes for producing the printing original plates.

(1) A solid-ink printing original plate which comprises a substrate and an image comprising an ink dot formed on the substrate, and which is prepared by a process comprising the steps of:

melting a solid ink that is a solid at a room temperature; and jetting the melt of the solid ink onto a substrate to form an ink dot, wherein the ink dots that have solidified on the substrate have an ink dot height of at least 5 $\mu$m, and a ratio (aspect ratio) of the ink dot height to the minor axis size of the ink dot of from 0.05 to 0.5.

(2) The solid-ink printing original plate according to the above (1), wherein the ink dots that have solidified on the substrate have a ratio (in-plane aspect ratio) of the major axis size to the minor axis size thereof of 2.0 or less.

(3) The solid-ink printing original plate according to the above (2), wherein the in-plane aspect ratio is 1.5 or less.

(4) The solid-ink printing original plate according to the above (1), wherein the ink dots that have solidified on the substrate have a minimum minor axis of not less than 10 $\mu$m.

(5) The solid-ink printing original plate according to the above (1), wherein the ink dots that have solidified on the substrate have a contact angle of at least 15° with respect to the substrate.

(6) The solid-ink printing original plate according to the above (5), wherein the contact angle is at least 20°.

(7) A process for producing the solid-ink printing original plate according to any one of the above (1) to (6), wherein the solid link has a melt viscosity of from 10 to 30 mpa·s upon jetting.

(8) A process for producing the solid-ink printing original plate according to any one of the above (1) to (6), wherein the solid ink has a surface tension of 15 to 35 mN/m upon jetting.

(9) A process for producing the solid-ink printing original plate according to any one of the above (1) to (6), wherein the solid ink comprises a vehicle ingredient containing a compound having a solubility parameter of from 8.5 to 10.5 as expressed by the Fedors equation in an amount of not less than 95 wt % based on the weight of the vehicle ingredient.

(10) A process for producing the solid-ink printing original plate according to any one of the above (1) to (6), wherein the solid ink contains carnauba wax.

(11) A process for producing the solid-ink printing original plate according to any one of the above (1) to (6), wherein the jetting step is conducted onto an intermediate medium to form an image of ink dots, and the formed image is transferred from the intermediate medium onto a substrate.

The present invention is primarily directed to press plates for use in offset printing (as in lithographic printing and web offset printing) and also directed to processes for producing such plates. However, as will be easily inferred by the skilled artisan, the concept of the invention is equally applicable to other printing systems such as letterpress printing, screen printing, flexography and gravure printing by adopting similar techniques.

The solid ink of the invention is primarily intended to be applied by an ink-jet system of a pulse-pressure type that relies upon the electromechanical transducing characteristic of a piezoelectric element. However, as will be easily inferred by the skilled artisan, the concept of the present invention is equally applicable to other ink-jet systems such as continuous ink-jet system that relies upon piezoelectricity and thermal ink-jet system which utilizes a pressure accompanied by the generation of bubbles.

PREFERRED EMBODIMENTS OF THE INVENTION

The present invention has been accomplished as the result of the various studies conducted by the present inventors to find an optimal method of using a solid ink on a press plate. Briefly, for improving the abrasion resistance, the following three characteristics are most influential: (1) the three-dimensional shape of an ink dot, (2) the characteristics of an ink being jetted; and (3) the characteristics of ink materials. The respective characteristics are discussed below seriatim.

(1) Speaking of the shape of an ink dot first, the ink layer has a height (thickness) of at least 5 $\mu$m. Below 5 $\mu$m, the intended deposition and transfer of the solid ink may not be attained and the deposited ink dots may not be improved in abrasion resistance but may suffer the problem of short life as in the case of the conventional liquid inks. There is no particular upper limit for the thickness of the solid ink layer but typically it is 100 $\mu$m or less, more preferably 50 $\mu$m or less.

In order to ensure that the thickness of each ink dot lies within the preferred range, the amount of the ink to be jetted may be controlled electrically or the nozzle diameter may be adjusted to be within the desired range. For attaining best results in maintaining the adhesion of ink to the substrate during printing and the mechanical strength of ink dots, ink dots are required to have a profile in the direction of height (depth) such that the aspect ratio defined by the height of the ink dot relative to its diameter is within the range of 0.05 to 0.5. If the aspect ratio is higher than 1.0, ink dots tend to be dislodged from the substrate in the printing step; if the aspect ratio is lower than 0.025, the ink dots will wear prematurely and the same problems occur as when the thickness of the ink layer is unduly small.

When the angle of contact between an ink dot and the substrate (i.e., maximum contact angle corresponding to the minor axis direction of an elliptical dot) is adjusted to be 15° or more, particularly 20° or more, the contrast of the deposited ink is sufficiently increased to prolong its life. If the angle of contact is unduly small, the ink dot wear from either end at a faster rate than when the contact angle is optimal.

Other methods of optimizing the shape of ink dots include deforming them by applying heat or pressure during or after printing or heating the substrate before printing (as described in JP-A-1-127358 (corresponding to U.S. Pat. No. 4,853,706), JP-A-2-561, JP-W-A-2-502175 (The term "JP-W-A" used herein means an "published Japanese national stage of international patent application"), JP-B-5-18716, JP-B-54826 and JP-A-7-323539) and forming an ink dot pattern on a suitable medium (transfer medium) before it is transferred onto the substrate for making a press plate (as described in JP-A-6-206368 (corresponding to U.S. Pat. No. 5,372,852), JP-A-6-293178 (corresponding to U.S. Pat. No. 5,389,958), JP-A-7-168451, JP-A-7-276621, JP-A-7-508226, JP-A-5-200997 (corresponding to U.S. Pat. No. 5,471,233) and JP-A-6-143552). These methods are also effective in improving the quality of prints.

If adjacent ink dots in a pattern are close enough to overlap each other, the valley portion formed by the overlapping hemispherical dots may occasionally prevent the printing ink from being effectively transferred onto a sheet of printing paper, thereby causing unevenness in prints. In order to smooth out the surface areas of such ink dot groups so that the printing ink will be uniformly transferred onto the printing paper, optimizing the shape of ink dots by the above-described application of heat or pressure and pattern transfer is effective.

The as-solidified ink dots are usually spherical or elliptical in shape. For achieving high-definition recording as in the making of press plates, it is desirable that the shape of as-solidified ink dots is close to a circle as regularly as possible. The present inventors have found experimentally that ink dots having an in-plane aspect ratio (major-to-minor axis ratio) of 2.0 or less, particularly 1.5 or less are referred for practical purposes. The aforementioned electrical control, nozzle shape, application of heat or pressure before or after printing may also be employed for the purpose of attaining the stated aspect ratios. If the in-plate aspect ratio exceeds 2.0, the prints from the press plate are so low in quality that the plate may by no means be suitable for practical use. In addition, the printed ink dots may deform to a non-elliptical shape, occasionally producing tiny dots called "satellites". These defective dot shapes also contribute to deteriorate the quality of prints and what is particularly problematic is the change in quality due to the dislodging of tiny dots during printing. The present inventors confirmed experimentally that no such problems would occur when the dot diameter was 10 $\mu$m or greater.

(2) Speaking of the characteristics of the ink being jetted, it must have sufficient physical characteristics to realize the aforementioned shape of ink dots.

The ink has desirably a viscosity of 10 to 30 mpa·s when it is being jetted. Below 10 mpa·s, the resulting ink dots often fail to provide the edge sharpness necessary for press plate; beyond 30 mpa·s, the ink is so viscous that ink-jet printing itself becomes difficult to perform.

Depending on the properties of substrate materials such as paper and metals, the ink has desirably a surface tension in the range of 15 to 35 mN/m. If the ink has an excessive surface tension, its cohesion on the substrate will distort the shape of ink dots; if the ink has an unduly small surface tension, the tailings of the ink dots in flight becomes excessive, making it difficult to attain the above-mentioned optimal shape of ink dots. It should also be stressed that adjusting the surface tension of ink to lie within the stated range is important for realizing oleophilicity that provides contrast with the hydrophilic substrate, thereby optimizing the deposition of a printing ink on the substrate (its compatibility with the ink) when it is subjected to printing as a press plate.

(3) Various well-known solid inks are useful as ink materials in the present invention. For several examples, see JP-A-55-54368, JP-A-58-108271 (corresponding to U.S. Pat. No. 4,390,319), JP-A-61-159470 (corresponding to U.S. Pat. No. 4,659,383), JP-A-61-141750, JP-A-61-83268, JP-B-62-41112, JP-A-62-48774 (corresponding to U.S. Pat. No. 4,820,346), JP-A-62-295973, JP-A-64-27953, JP-A-295973, JP-A-63-501430, JP-A-2-206661, JP-A-2-229870, JP-A-5-194897, JP-A-5-311101, JP-A-6-107987, JP-A-6-240195, JP-A-6-116521, JP-A-2-281083, JP-A-3-153773, JP-A-4-117468, JP-A-7-70490, JP-A-8-165447, JP-A-9-3377, JP-A-9-71743, JP-W-A-506881, JP-B-4-74193 and JP-B-7-115470.

The present inventors found that the incorporation of carnauba wax as an ink ingredient was particularly effective in improving the ink characteristics. The inventors also found that an ink prepared by optionally incorporating a vehicle compound having a compatibility parameter of 8.5 to 10.5 had particularly good affinity for printing inks for use on press plates, as exemplified by the provision of oleophilicity, so that it exhibited outstanding printing characteristics. For calculating the compatibility parameter, the present invention relies upon the Fedors equation and details of this equation and its application are given in various monographs such as "Gijutsusha no tameno Jitsugaku Kobunshi (Practical Polymer Science for Engineers)", Junji Mukai et al., page 66, Kodansha, 1981.

The constituent materials of the ink composition for use in the present invention is described below.

The vehicle for use in the solid ink composition of the invention is not limited to any particular materials and it may comprise one or more components selected from among monoamides, bisamides, tetramides, polyamides, ester amides, polyesters, polyvinyl acetates, acrylic and methacrylic acid based polymers, styrenic polymers, ethylene-vinyl acetate copolymer, polyketones, silicones, coumarone, aliphatic acid esters, triglycerides, natural resins, and natural and synthetic waxes.

Specific examples of polyamide resins include: Versamide 711, Versamide 725, Versamide 930, Versamide 940, Versalon 1117, Versalon 1138 and Versalon 1300 (all being produced by Henkel), as well as Tomide 391, Tomide 393, Tomide 394, Tomide 395, Tomide 397, Tomide 509, Tomide 535, Tomide 558, Tomide 560, Tomide 1310, Tomide 1396, Tomide 90 and Tomide 92 (all being produced by Fuji Kasei K.K.). Exemplary polyesters include KTR2150 (product of Kao Corp.); exemplary polyvinyl acetates include AC401, AC540 and CAC580 (all being produced by Allied Chemical); exemplary silicones include Silicone SH6018 (product of Toray Silicone Co., Ltd.), Silicone KR215, Silicone KR216 and Silicone KR220 (all being produced by Shin-Etsu Silicone Co., Ltd.); exemplary cumarones include Escron G-90 (product of Nippon Steel Chemical Co., Ltd.).

By using the resin either alone or in combination with aliphatic acids, aliphatic acid amides, glycerides, waxes and others that are compatible with other ink ingredients, the solidification of the ink can be retarded to produce a sharp image.

Specific examples of such aliphatic acids include acids such as stearic acid, arachic acid, behenic acid, lignoceric acid, cerotic acid, montanic acid and melissic acid, as well as esters thereof, which may be used either alone or in admixture; exemplary aliphatic acid amides include lauric acid amide, stearic acid amide, oleic acid amide, erucic acid amide, ricinoleic acid amide, stearic acid ester amide, palmitic acid amide, behenic acid amide and brascidic acid, which may be used either alone or in admixture.

Exemplary glycerides include rosin ester, lanolin ester, hydrogenated castor oil, partially hydrogenated castor oil, extremely hydrogenated soybean oil, extremely hydrogenated rapeseed oil and other extremely hydrogenated vegetable oils, which may be used either alone or in admixture.

Other specific examples of vehicle materials include: petroleum-based waxes such as paraffin wax and microcrystalline wax; vegetable waxes typified by candelilla wax and carnauba wax; polyethylene wax and hydrogenated castor oil; higher aliphatic acids such as palmitic acid, oleic acid, stearic acid and behenic acid; higher alcohols; and ketones such as stearone and laurone; particularly desirable vehicle materials include aliphatic acid ester amides, saturated or unsaturated aliphatic acid amides, and aliphatic acid esters.

A suitably aliphatic acid ester amide is CPH-380N (product of CP Hall).

Suitable aliphatic acid amides include: lauric acid amide, stearic acid amide, oleic acid amide, erucic acid amide, ricinoleic acid amide, stearic acid ester amide, palmitic acid amide, behenic acid amide and brascidic acid amide. Suitable N-substituted aliphatic acid amides include: N,N'-Z-hydroxystearic acid amide, N,N'-ethylenebisoleic acid amide, N,N'-xylenebisstearic acid amide, stearic acid monomethylol amide, N-oleylstearic acid amide, N-stearylstearic acid amide, N-oleylpalmitic acid amide, N-stearylerucic acid amide, N,N'-dioleyladipic acid amide, N,N'-dioleylsebacic acid amide, N,N'-distearylisophthalic acid amide, and 2-stearamide ethyl stearate.

Desirable aliphatic acid esters are mono- or polyhydric alcohol esters of aliphatic acids, as exemplified by sorbitan monopalmitate, sorbitan monostearate, sorbitan monobehenate, polyethylene glycol monostearate, polyethylene glycol distearate, propylene glycol monostearate and ethylene glycol distearate.

Specific examples that can be used include Reodol SP-S10, Reodol SP-S30, Reodol SA10, Emazol P-10, Emazol S-10, Emazol S-20, Emazol B, Reodol Super SP-S10, Emanone 3199, Emanone 3299 and Exeparl PE-MS (all being produced by Kao Corp.)

The most preferred are aliphatic acid esters of glycerin, as exemplified by stearic acid monoglyceride, palmitic acid monoglyceride, oleic acid monoglyceride and behenic acid monoglyceride.

Specific examples that can be used include Reodol MS-50, Reodol MS-60, Reodol MS-165, Reodol MO-60 and Exeparl G-MB (all being produced by Kao Corp.), deodorized and purified carnauba wax No. 1 and purified candelilla wax No. 1 (both being produced by Noda Wax K.K.), Syncrowax ERL-C and Syncrowax HR-C (product of Croda), and KF2 (product of Kawaken Fine Chemicals Co., Ltd.)

Special ester-based waxes may also be used and they include Exeparl DS-C2 (Kao), as well as Kawaslip-L and Kawaslip-R (Kawaken Fine Chemicals Co., Ltd.) Also useful are higher alcohol esters of higher aliphatic acids, as exemplified by myricyl cerotate, ceryl cerotate, ceryl montanate, myricyl palmitate, myricyl stearate, cetyl palmitate and cetyl stearate.

Aliphatic acid amides have low melt viscosities at temperatures of about 100° C. and are remarkably effective in depressing the melting point of an ink and lowering the viscosity of a molten ink. Aliphatic acid amides provide not only stable fluidity when the ink is molten, but also provide sufficient strength of a printed image endurable against rubbing and bending. Aliphatic acid esters have low melt viscosities and provide stable fluidity when the ink is molten; in addition, they are more flexible and ensure a stronger surface protective force than compounds having carbon-carbon bonds and, hence, the resulting ink can reasonably withstand repeated bending of the printed image. Preferred aliphatic acid esters are those that have a penetration index greater than 1 and which are easy to process under pressure. More suitable are those which, when jetted, have viscosities smaller than 30 mpa·s.

Polyamides are generally classified into two main groups, aromatic based and dimer acid based. Dimer acid based polyamides are particularly desirable for the purposes of the invention. Optimally, the base acid is oleic acid, linolic acid, linoleic acid or eleostearic acid.

Specific examples include Macromelt 6030, Macromelt 6085, Macromelt 6071, Macromelt 6121, Macromelt 6217, Macromelt 6224, Macromelt 6228, Macromelt 238, Macromelt 6239, Macromelt 6240, Macromelt 6301, Macromelt 6900, DPX 335-10, DPX H-415, DPX 335-11, DPX 830, DPX 850, DPX 925, DPX 927, DPX 1180, DPX 1163, DPX 1175, DPX 1186, DPX 1358 (product of Henkel Hakusui), SYLVAMID E-5 (Arizona Chemical), UNIREZ 2224 and UNIREZ 2970 (Union Camp).

Vehicles that are selected from among the compounds listed above may be used either alone or in admixture. All of the vehicle materials mentioned above are capable of wetting various kinds of recording media by a sufficient extent to exhibit high bonding performance. They also exhibit good adhesion to various kinds of adherend materials.

The coloring agent for use in the invention is desirably a dye or a pigment that are evenly dispersed in the vehicle described above, the have high heat stability and that will not adversely affect the printing ink during printing. Any coloring agents exemplified by oil-based dyes may be used as long as they are compatible with other ink components. The primary objective of the coloring agent is to render the state of ink deposition visible so as to facilitate its evaluation. A suitable amount of the addition of the coloring agent is in the range of 0.2 to 5 wt %. Below 0.2 wt %, the quality of the printed image may deteriorate; beyond 5 wt %, the viscosity characteristics of the ink may be adversely affected. For color adjustment and other purposes, two or more coloring agents may be mixed as appropriate. In order to afford additional functions to the ink composition of the invention, various kinds of surface treating agents, surfactants, viscosity reducing agents, antioxidants, antiseptics and other additives may be incorporated.

To further enhance its functions, the solid ink composition of the invention may incorporate various kinds of resin components, surface treating agents, surfactants, viscosity reducing agents, antioxidants, antiseptics, uv absorbers and plasticizers.

A balance of various important factors is required to prepare a solid ink composition of high quality. The ink of the invention satisfies well-known requirements for application to solid ink-jet printers. Specifically, the ink has adequate hardness and stability at a room temperature and assures reliability in both prepress storage and the quality of printed image. After being deposited on the recording medium, the ink keeps adequate degrees of transparency and saturation and it also forms a sufficiently uniform thin film to provide prints of good image quality. These requirements are complex phenomena and cannot necessarily be expressed by clear-cut numerical figures for the ink of the invention. However, it can at least be said that a hot melt ink having a relatively low melting point typically tends to bleed and cause an offset. No offset should occur even if prints are stacked at a storage temperature of 40° C.. An excessively viscous ink requires a greater energy to be jetted. A material of unduly small viscosity gives rise to a problem in terms of storage stability at a room temperature. The ink preferably has a viscosity of at least 10,000 mpa·s at a room temperature (25° C).

By increasing the jetting temperature, viscosity of most inks can be lowered to be within a range suitable for jetting. On the other hand, an increased jetting temperature might cause a problem in heat stability and prolonged heating within the ink reservoir (ink chamber) or the print head could potentially result in ink decomposition or corrode the metallic material in contact with the ink.

Prints desirably have such bending characteristics that they pass a test on a mandrel with a transparency film at a bend diameter of 5 mm or less, particularly 3 mm or less. To permit the use of a convenient and low-cost apparatus, the temperature at which the ink is melted during printing is optimally within the range of 100 to 150° C. To meet this requirement, the ink has desirably a melting point of from 60 to 100° C., more desirably at least 70° C. The ink desirably experiences a volume change of not more than 10% upon transition from a molten to a solid state.

When preparing a press plate using the solid ink described above, various materials can be used as a substrate without any particular limitations. Examples of suitable substrate materials include paper that is surface treated with kaolin clay, aluminosilicates and the like, plastic films made of polyesters or the like and paper laminated with plastics, metal plates such as Zn, Al and stainless steel plates that are specified in JIS H4321 and JIS H4000, as well as paper and plastics having metal coatings on the surface. Most common substrate materials are metallic Al plates that are grained by various polishing methods or which are surface treated by electrochemical techniques or anodization. These substrates may be overlaid with various resin coats in order to improve their ink receptivity.

The foregoing description assumes a press plate in either a sheet or a plate form but this is not the sole case of the invention and it will be apparent to the skilled artisan that an ink dot pattern may be directly formed on a printing drum so that it is immediately subjected to printing. The invention is principally intended to make a (lithographic) press plate for use in offset printing; however, press plates for screen printing, flexography, letterpress printing and gravure printing can of course be produced by similar techniques using the solid ink of the invention and incorporating improvements as apparent to the skilled artisan.

The solid ink of the invention is typically deposited directly on the substrate but better quality may be achieved by applying heat or pressure the substrate before, after or during ink deposition. Depending on the object, the ink may be deposited on a suitable medium before it is transferred onto the substrate as already described above.

After the solid ink is deposited, an ordinary etching treatment may be applied to improve the hydrophilicity of the areas where the solid ink is not deposited. Depending on the type of substrate, processing solutions used in other applications (e.g. PS plates) may also be used and they include, but are not limited to, aqueous solutions of ferric chloride, cupric chloride and ammonium persulfate, a mixture of chromic acid and sulfuric acid, and solvent-free systems. After these treatments, gumming may optionally be performed.

The press plate of the invention can be used with various printing inks without any particular limitations and they include regular inks, process inks, web offset printing ink, metal plate inks, gravure inks, fluorescent inks, metal powder inks, carbon ink, OCR inks, magnetic inks, resist inks, electroconductive inks, bar code inks, temperature-sensitive inks, foaming inks, liquid-crystal inks, inks for pharmaceuticals and calico printing inks. If the printing ink is specified, it is of course possible to reselect a compatible solid ink composition in accordance with solubility parameter and other factors.

It should also be noted that the ink composition of the invention can be used on known types of ink-jet printers that jet ink droplets only when printing need be done, as exemplified by printers for office use, printers for use in industrial systems, wide-format compatible printers, platemaking printers, label printers and all types of printers that allow for the typical operation just described above. Exemplary recording media that can be used include paper, plastic films, capsules, gels, metal foils and so forth; it should, however, be noted that since the ink composition of the invention permits non-contact printing the media that can be used may vary widely in shape and are by no means limited to the examples just mentioned above.

The present invention will be described in greater detail with reference to the following Examples, but should not be construed as being limited thereto.

First Embodiment

Behenic acid (product of Croda) in varying amounts of 100, 80, 60, 40, 20 and 0 parts by weight and carnauba wax (product of Nippon Seiro Co., Ltd.) in varying amounts of 0, 20, 40, 60, 80 and 100 parts by weight were mixed with 1.5 parts by weight of a black dye (Oil Black SN; product of Chuo Gosei Kagaku K.K.) The resulting mixtures each weighing 400 g were heated and blended at 130° C. until a homogeneous melt formed and subsequently filtered under application of heat and pressure to remove the impurities and the like; thereafter, the pure products were left to cool at a room temperature to prepare six samples of black solid ink.

Using a solid ink printer (JOLT-PS01J; product of Hitachi Koki Co., Ltd.), the ink samples were deposited to provide test patterns on sheets of paper for press plate making (Toyoplate DL; product of Xante). The sheets of paper with the thus deposited ink dots were each fitted on an offset printing press (66IIP; product of Shinohara Shoji K.K.) and subjected to a multiples printing test at a speed of 10,000 sheets per hour. The quality of prints was evaluated in terms of nicks in the pattern and their life was considered to have reached an end when a nick was observed in a visual field at a magnification of 10. The results are shown in Table 1 below. The "ink dot height" and "major-to-minor axis ratio (aspect ratio)" are each the average taken for about 100 dots. Viscosity measurement was done with a rotary viscometer (EDL Model; product of TOKIMEC) and surface tension measurement with a Wilhelmier-type surface tension meter (Model CBVPZ; product of Kyowa Kaimen Kagaku K.K.).

TABLE 1

| | Sample No. | | | | | |
|---|---|---|---|---|---|---|
| | 1 Comp. Ex. 1 | 2 Ex. 1 | 3 Ex. 2 | 4 Ex. 3 | 5 Ex. 4 | 6 Ex. 5 |
| Behenic acid (parts) | 100 | 80 | 60 | 40 | 20 | 0 |
| Carnauba wax | 0 | 20 | 40 | 60 | 80 | 100 |

TABLE 1-continued

| | Sample No. | | | | | |
|---|---|---|---|---|---|---|
| | 1 Comp. Ex. 1 | 2 Ex. 1 | 3 Ex. 2 | 4 Ex. 3 | 5 Ex. 4 | 6 Ex. 5 |
| (parts) | | | | | | |
| Black dye (parts) | 1.5 | 1.5 | 1.5 | 1.5 | 1.5 | 1.5 |
| Ink dot height (μm) | 4 | 20 | 18 | 17 | 15 | 15 |
| Height-to-dot diameter ratio | 0.6 | 0.2 | 0.2 | 0.2 | 0.2 | 0.2 |
| Major-to-minor axis ratio | >2.0 | 1.4 | 1.4 | 1.4 | 1.5 | 1.5 |
| Minimum minor axis (μm) | about 7 | >50 | >50 | >50 | >50 | >50 |
| Dot contact angle (°) | <15 | 30 | 35 | 30 | 30 | 35 |
| Melt viscosity (mPa · s) | 5.0 | 8.5 | 10.0 | 11.8 | 11.2 | 12.5 |
| Surface tension (mN/m) | 30 | 27 | 24 | 23 | 22 | 22 |
| Press life (sheets) | 5,000 | 40,000 | >50,000 | >50,000 | >50,000 | >50,000 |

The melt viscosities of the respective ink samples in the process of printing are listed in Table 1, from which one can see that the ink samples according to the invention (Nos. 2 to 6) which gave dot heights of more than 10 μm contributed to extend the press life; sample No. 2 having a melt viscosity of 8.5 mpa·s could be used to produce 40,000 sheets and sample Nos. 3 to 6 which had melt viscosities of 10 mpa·s and more could be used to produce more than 50,000 sheets.

Second Embodiment

Sixty parts by weight of a monoamide (Kemamide S-180; product of Witco), 18 parts by weight of a bisamide (Slipax O; Product of Nippon Kasei K.K.), 14 parts by weight of a tetramide (Unirez 2970; product of Union Camp), 6 parts by weight of an alicyclic hydrocarbon (Alcon E-90; product of Arakawa Kagaku K.K.) and 2 parts by weight of a cyan dye (Neopen Blue 808; product of BASF) were mixed, heated and blended at 130° C. until a homogeneous melt formed and subsequently filtered under application of heat and pressure to remove the impurities and the like; thereafter, the pure product was left to cool at a room temperature to prepare a solid ink which, when heated, had a viscosity of 15 mpa·s.

The same procedure was repeated to prepare three additional ink samples by replacing part of the above-described composition with an aliphatic acid ester amide (Kawaslip SA; product of Kawaken Fine Chemicals Co., Ltd.), a polyethylene wax (Polywax 655; product of Petrolite) and a polyamide (Versamide 100; product of Henkel), respectively.

The four ink samples were deposited in patterns on substrates for press plate making (direct plate material produced by Oki Data Co., Ltd.) and subjected to a printing test on an offset press at a speed of 10,000 sheets per hour. The results were evaluated by the same method as in the first embodiment. The solubility parameters of the individual ingredients were calculated by the Fedors equation as relative to the main ingredient of each sample. The results are shown in Table 2 below.

TABLE 2

| | Sample No. | | | | |
|---|---|---|---|---|---|
| | 7 Ex. 6 | 8 Ex. 7 | 9 Comp. Ex. 2 | 10 Ex. 8 | Solubility parameter |
| Monoamide (parts) | 60 | — | 60 | 60 | 9.0 |
| Bisamide (parts) | 18 | 18 | 18 | 18 | 10.5 |
| Tetramide (parts) | 14 | 14 | 14 | 14 | 9.8 |
| Alicyclic hydrocarbon (parts) | 6 | — | — | — | 9.0 |
| Ester amide (parts) | — | 60 | — | — | 9.2 |
| Polyethylene wax, (parts) | — | — | 6 | — | 8.0 |
| Polyamide (parts) | — | — | — | 6 | 11.8 |
| Coloring matter (parts) | 2 | 2 | 2 | 2 | — |
| Dot height (μm) | 18 | 17 | 4 | 5 | |
| Height-to-dot diameter ratio | 0.25 | 0.28 | 0.55 | 0.25 | |
| Major-to-minor axis ratio | 1.3 | 1.3 | 2.0 | 1.6 | |
| Minimum minor axis | >50 | >50 | 11 | 20 | |

TABLE 2-continued

| | Sample No. | | | | |
|---|---|---|---|---|---|
| | 7 Ex. 6 | 8 Ex. 7 | 9 Comp. Ex. 2 | 10 Ex. 8 | Solubility parameter |
| (μm) | | | | | |
| Dot contact angle (°) | 42 | 44 | 60 | 55 | |
| Viscosity (mPa · s) | 15.0 | 12.3 | 31 | 26 | |
| Surface tension (mN/m) | 24 | 24 | 23 | 30 | |
| Press life (sheets) | >50,000 | >50,000 | <1,000 | 20,000 | |

The sample of Comparative Example 2 formed very small ink dots (4 μm) and was very short-lived on account of the use of a material having a solubility parameter of 8.0. The life of the other samples which were prepared according to the invention was satisfactory, except that the sample of Example 8 which used a material having a solubility parameter of 11.8 could only be used to print 20,000 sheets whereas the other samples of the invention could be used to print more than 50,000 sheets.

Third Embodiment

Using a solid ink printer (product of Sony Techtronics Co., Ltd.) of a transfer type that formed an ink dot pattern on a drum before it was transferred onto a substrate, an ink of the same formulation as used in Example 6 was deposited to form a test pattern of ink dots on a substrate for press plate making (Omega Plate; product of Xante) which was cut to a desired size. The height of the ink dots was about 10 μm and the height-to-minor axis ratio was about 0.05. The resulting press plate was subjected to a printing test on an offset press as in Example 6 and it was found to have a press life longer than 50,000 sheets.

Fourth Embodiment

An ester amide (Kawaslip SA; product of Kawaken Fine Chemicals Co., Ltd.) in varying amounts of 100, 80, 60, 40, 20 and 0 parts by weight and carnauba wax (product of Noda Wax K.K.) in varying amounts of 0, 20, 40 , 60, 80 and 100 parts by weight were mixed with 2.0 parts by weight of a black dye (Oil Black BY; product of Orient Chemical Industry Co., Ltd.) The resulting mixture were heated and blended at 130° C. until homogeneous melts formed and subsequently filtered under application of heat and pressure to remove the impurities and the like; thereafter, the pure products were left to cool at a room temperature to prepare six samples of black solid ink. Using a flat-bed type platemaker having an ink-jet head fitted with piezoelectric devices, the ink samples were jetted to form test patterns of ink dots on aluminum-based substrates for press plate making. The thus prepared press plates were evaluated for their printing performance on an offset press. The results are shown in Table 3 below.

TABLE 3

| | Sample No. | | | | | |
|---|---|---|---|---|---|---|
| | 11 Ex. 10 | 12 Ex. 11 | 13 Ex. 12 | 14 Ex. 13 | 15 Ex. 14 | 16 Ex. 15 |
| Ester amide (parts) | 100 | 80 | 60 | 40 | 20 | 0 |
| Carnauba wax (parts) | 0 | 20 | 40 | 60 | 80 | 100 |
| Black dye (parts) | 2.0 | 2.0 | 2.0 | 2.0 | 2.0 | 2.0 |
| Ink dot height (μm) | 13 | 10 | 10 | 10 | 8 | 5 |
| Height-to-dot diameter ratio | 0.3 | 0.3 | 0.3 | 0.3 | 0.4 | 0.5 |
| Major-to-minor axis ratio | 1.1 | 1.1 | 1.3 | 1.3 | 1.6 | 2 |
| Minimum minor axis (μm) | 30 | 35 | 30 | 25 | 25 | 10 |
| Dot contact angle (°) | 40 | 50 | 46 | 46 | 50 | 80 |
| Melt viscosity (mPa · s) | 9.0 | 10.0 | 10.6 | 11.5 | 11.7 | 12.5 |
| Surface tension (mN/m) | 20 | 22 | 22 | 23 | 23 | 24 |
| Press life (sheets) | 40,000 | >50,000 | >50,000 | >50,000 | >50,000 | >50,000 |

All samples were satisfactory in life characteristics, except that the sample of Example 10 which had a melt viscosity of 9.0 mpa·s could only be used to print 40,000 sheets whereas the other samples of the invention could be used to print more than 50,000 sheets.

Thus, according to the present invention, direct press plates that are long-lived and which have satisfactory printing characteristics can be produced by a simple process.

While the invention has been described in detail with reference to specific embodiments thereof, it will be apparent to one skilled in the art that various changes and modifications can be made therein without departing from the spirit and scope thereof.

What is claimed is:

1. A solid-ink printing original plate which comprises a substrate and an image comprising ink dots formed on the substrate, and which is prepared by a process comprising the steps of:

melting a solid ink that is a solid at a room temperature; and jetting the melt of the solid ink onto the substrate to form the ink dots, wherein the ink dots that have solidified on the substrate have an ink dot height of at least 5 μm, and a ratio (aspect ratio) of the ink dot height to a minor axis size of the ink dot of from 0.05 to 0.5.

2. The solid-ink printing original plate according to claim 1, wherein the ink dots that have solidified on the substrate have a ratio (in-plane aspect ratio) of a major axis size to the minor axis size thereof of 2.0 or less.

3. The solid-ink printing original plate according to claim 2, wherein the in-plane aspect ratio is 1.5 or less.

4. The solid-ink printing original plate according to claim 1, wherein the ink dots that have solidified on the substrate have a minimum minor axis of not less than 10 μm.

5. The solid-ink printing original plate according to claim 1, wherein the ink dots that have solidified on the substrate have a contact angle of at least 15° with respect to the substrate.

6. The solid-ink printing original plate according to claim 5, wherein the contact angle is at least 20°.

7. A process for producing a solid-ink printing original plate comprising the steps of:

melting a solid ink that is a solid at a room temperature; and jetting the melt of the solid ink onto a substrate to form ink dots, wherein the ink dots that have solidified on the substrate have an ink dot height of at least 5 μm, and a ratio (aspect ratio) of the ink dot height to a minor axis size of the ink dot of from 0.05 to 0.5, wherein the solid ink has melt viscosity of from 10 to 30 mPa·s upon jetting.

8. The process for producing a solid-ink printing original plate according to claim 7, wherein the solid ink has a surface tension of 15 to 35 mN/m upon jetting.

9. The process for producing a solid-ink printing original plate according to claim 7, wherein the solid ink comprises a vehicle ingredient containing a compound having a solubility parameter of from 8.5 to 10.5 as expressed by the Fedors equation in an amount of not less than 95 wt % based on the weight of the vehicle ingredient.

10. The process for producing a solid-ink printing original plate according to claim 7, wherein the solid ink contains carnauba wax.

11. The process for producing a solid-ink printing original plate according to claim 7, wherein the jetting step is conducted onto an intermediate medium to form an image of ink dots, and the formed image is transferred from the intermediate medium onto the substrate.

12. The process for producing a solid-ink printing original plate according to any one of claims 7 to 11, wherein the ink dots that have solidified on the substrate have a ratio (in-plane aspect ratio) of a major axis size to the minor axis size thereof of 2.0 or less.

13. The process for producing a solid-ink printing original plate according to claim 12, wherein the in-plane aspect ratio is 1.5 or less.

14. The process for producing a solid-ink printing original plate according to any one of claims 7 to 11, wherein the ink dots that have solidified on the substrate have a minimum minor axis of not less than 10 μm.

15. The process for producing a solid-ink printing original plate according to any one of claims 7 to 11, wherein the ink dots that have solidified on the substrate have a contact angle of at least 15° with respect to the substrate.

16. The process for producing a solid-ink printing original plate according to claim 15, wherein the contact angle is at least 20'.

* * * * *